US010128058B2

(12) United States Patent
Lang

(10) Patent No.: US 10,128,058 B2
(45) Date of Patent: Nov. 13, 2018

(54) SWITCHING DEVICE HAVING A DRIVE FOR FUNCTIONAL SWITCHING AND A HIGH-SPEED CIRCUIT BREAKER FOR BREAKING A CURRENT PATH IN THE SWITCHING DEVICE

(71) Applicant: Eaton Electrical IP GmbH & Co. KG, Schoenefeld (DE)

(72) Inventor: Volker Lang, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/529,087

(22) PCT Filed: Nov. 24, 2015

(86) PCT No.: PCT/EP2015/077462
§ 371 (c)(1),
(2) Date: May 24, 2017

(87) PCT Pub. No.: WO2016/083350
PCT Pub. Date: Jun. 2, 2016

(65) Prior Publication Data

US 2017/0345585 A1 Nov. 30, 2017

(30) Foreign Application Priority Data

Nov. 28, 2014 (DE) ..... 10 2014 117 491

(51) Int. Cl.
*H01H 71/24* (2006.01)
*H01H 1/20* (2006.01)
*H01H 89/08* (2006.01)

(52) U.S. Cl.
CPC ..... *H01H 1/2008* (2013.01); *H01H 71/2463* (2013.01); *H01H 89/08* (2013.01)

(58) Field of Classification Search
CPC .... H01H 71/2409; H01H 71/24; H01H 71/12; H01H 71/2463; H01H 71/322; H01H 73/045
(Continued)

(56) References Cited

U.S. PATENT DOCUMENTS 4,456,662 A 6/1984 Malikowski et al.
8,138,440 B2 * 3/2012 Onufriyenko ..... H01H 73/045 218/154
(Continued)

FOREIGN PATENT DOCUMENTS

CN 1849686 A 10/2006
DE 3123357 A1 12/1982
(Continued)

*Primary Examiner* — Vanessa Girardi
(74) *Attorney, Agent, or Firm* — Leydig, Voit & Mayer, Ltd.

(57) ABSTRACT

A switching device, for the on-off switching of a current passing through a current path, has at least one fixed contact and at least one movable contact, wherein the movable contact can be moved relative to the fixed contact for making or breaking the current path, and a drive for the functional movement of a jumper between a contact-making position and a contact-breaking position. In the contact-making position with the fixed contact, the movable contact makes the current path. The switching device includes a high-speed circuit breaker for breaking the current path in the event of a short circuit or overload, wherein the armature of the high-speed circuit breaker is rigidly coupled to the movable contact.

14 Claims, 4 Drawing Sheets

(58) Field of Classification Search
USPC ..... 200/404; 335/3, 6
See application file for complete search history.

(56) References Cited

U.S. PATENT DOCUMENTS

| | | | | |
|---|---|---|---|---|
| 8,138,862 | B2 * | 3/2012 | Mueller | H01H 71/2409 200/237 |
| 2010/0006544 | A1 | 1/2010 | Onufriyenko et al. | |
| 2010/0019873 | A1 | 1/2010 | Mueller et al. | |

FOREIGN PATENT DOCUMENTS

| | | | |
|---|---|---|---|
| DE | 4318196 | A1 | 12/1994 |
| DE | 4322935 | A1 | 1/1995 |
| DE | 19740490 | C1 | 4/1999 |
| DE | 102006055007 | A1 | 5/2008 |
| WO | WO 2014023326 | A1 | 2/2014 |

* cited by examiner

SWITCHING DEVICE HAVING A DRIVE FOR FUNCTIONAL SWITCHING AND A HIGH-SPEED CIRCUIT BREAKER FOR BREAKING A CURRENT PATH IN THE SWITCHING DEVICE

CROSS-REFERENCE TO RELATED APPLICATIONS

This application is a U.S. national stage application under 35 U.S.C. § 371 of International Application No. PCT/EP2015/077462, filed on Nov. 24, 2015, and claims benefit to German Patent Application No. DE 10 2014 117 491.7, filed on Nov. 28, 2014. The International Application was published in German on Jun. 2, 2016, as WO 2016/083350 A1 under PCT Article 21(2).

FIELD

The invention relates to a switching device for the on-off switching of a current passing through a current path, having at least one fixed contact and at least one movable contact, wherein the movable contact can be moved relative to the fixed contact for making and breaking the current path.

BACKGROUND

Switching devices of this type with corresponding, generally electromagnetic drives are for example used in motor starters. These are to be suitable for the functional switching of a load, switching off an overload and switching off in the event of a short circuit. Basically, to achieve this functionality, two separate switching devices can also be used, namely a motor protection switch as the power switch and a contactor as the load switch. Alternatively, motor starters are known, in which the switching and protection function is integrated in one switching device. Generally, these have for this purpose a hand-operated, mechanical switching lock.

In document WO 2014/023326 A1, a switching device or a drive for a switching device for a compact and remotely-operated motor starter is described, with which the functional switching of the load, switching off the overload and switching off short circuits is to be implemented with only one device. The problem in switching off short circuits is the necessity to break the contacts made very quickly and permanently, so that a safe extinguishing of the arc is ensured and a re-ignition of the arc and a welding of the contacts are avoided. For this purpose, the drive has a bipolar electromagnetic drive unit having a movable armature and two stationary magnetic coils for the reversible movement of the armature between two permanent-magnetically stabilized armature positions, wherein a movable contact can be moved into the contact-making position by selective excitation of the first magnetic coil, and the movable contact can be moved within a maximum switching-off time, which is permissible for a short circuit in the current path, into the contact-breaking position by selective excitation of the second magnetic coil.

Electromagnetic drives, which are used for on-off switching, have the drawback that they have a comparatively large, moving mass, which is necessary for the switching-on process. Because of inertia, a drive of this type has a correspondingly long switching-off time, however. The switching-off times that can thus be achieved can potentially be too long to safely switch off a short circuit.

SUMMARY

An aspect of the invention provides a switching device for the on-off switching of a current passing through a current path, the switching device comprising: a fixed contact; a movable contact, the movable contact being moveable relative to the fixed contact so as to make or break the current path; a drive configured for functional movement of a jumper between a contact-making position and a contact-breaking position, wherein, in the contact-making position with the fixed contact, the movable contact makes the current path; and a high-speed circuit breaker configured to break the current path in the event of a short circuit or an overload, wherein the movable contact is configured to be movably guided along the jumper between a first stop and a second stop and is rigidly coupled to an armature of the high-speed circuit breaker.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
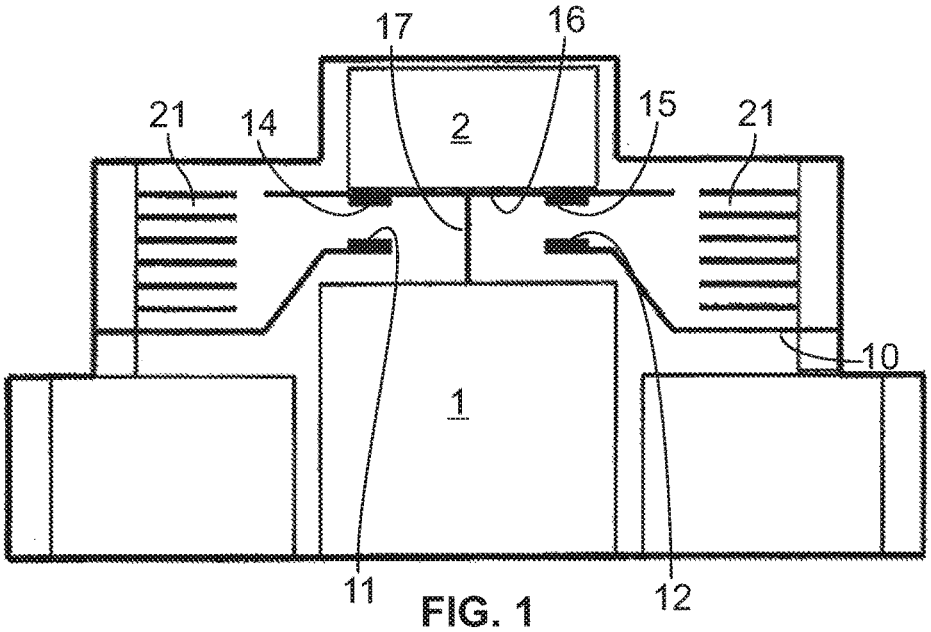
FIG. 1 a schematic view of the switching device according to the invention.

An aspect of the invention provides a switching device for the on-off switching of a current passing through a current path, comprising a high-speed circuit breaker for breaking the current path, with which switching off an overload and switching off short circuits can be carried out rapidly and safely regardless of a switching-off time of the drive for functional switching and which allows a compact, space-saving structure.

An aspect of the invention provides a switching device for the on-off switching of a current passing through a current path, having at least one fixed contact and at least one movable contact, wherein the movable contact can be moved relative to the fixed contact for making and breaking the current path, having a drive for the functional movement of a jumper between a contact-making position and a contact-breaking position, wherein, in the contact-making position with the fixed contact, the movable contact makes the current path, and having a high-speed circuit breaker for breaking the current path in the event of a short circuit or an overload.

The switching device according to an aspect of the invention for the on-off switching of a current passing through a current path has at least one fixed contact and at least one movable contact, wherein the movable contact can be moved relative to the fixed contact for making and breaking the current path. A contact system of this type may have a single contact pair. It is preferably configured to be double-breaking, two movable contacts being connected in particular by a movable contact carrier in order to be movable relative to two fixed contacts of the current path. The designations "movable contact" and "fixed contact" are used below without in each case dealing with the possibility of an embodiment having a double-breaking contact system, as this is familiar to a person skilled in the art. To this extent, a movable contact carrier having two movable contacts is also covered by the term "movable contact".

The switching device according to an aspect of the invention furthermore has a drive for the functional movement of a jumper between a contact-making position and a contact-breaking position, wherein the movable contact in the contact-making position with the fixed contact makes the current path so that the drive is also more generally designated a drive for the functional switching of the switching device.

Furthermore, the switching device according to an aspect of the invention has a high-speed circuit breaker for breaking the current path in the event of a short circuit or an overload. Both the drive for the functional switching of the switching device and the drive of the high-speed circuit breaker are preferably electromagnetic drives.

It is provided according to an aspect of the invention that the movable contact is movably guided along the jumper between a first stop and a second stop and is rigidly coupled to an armature of the high-speed circuit breaker.

One advantage of the switching device according to an aspect of the invention is that the movable contact movably guided along the jumper, in the circuit-making position of the jumper, can be separated from the fixed contact by the high-speed circuit breaker in the event of a short circuit. A person skilled in the art knows that, in the event of a short circuit, the lifting of the movable contacts is generally initially caused by electrodynamic lifting forces and that the high-speed circuit breaker preferably prevents the movable contacts from falling back and moves these further from the fixed contacts. This utilization of the known electrodynamic lifting forces when switching off short circuit currents is not necessarily also described here in connection with the triggering of the high-speed circuit breaker. The rigid coupling between the high-speed circuit breaker and the movable contact also advantageously ensures an accelerated triggering of the high-speed circuit breaker, as an air gap in the high-speed circuit breaker is thus already reduced due to the electrodynamic lifting. Furthermore, the rigid coupling allows a resetting of the movable contact, which was permanently broken after a triggering, with a simultaneously advantageously space-saving configuration and/or arrangement of the high-speed circuit breaker and/or drive for functional switching.

According to a preferred embodiment, it is provided that the armature of the high-speed circuit breaker is biased by means of a helical spring, so that the movable contact is biased by the helical spring in the direction of the first stop of the jumper. It is particularly preferably provided that the helical spring of the armature simultaneously acts as a contact pressure spring of the movable contact. In the contact-making position of the jumper, the movable contact biased in the direction of the first stop, makes the current path with the fixed contact, so that the helical spring of the armature simultaneously acts as a contact pressure spring of the movable contact. A separate contact pressure spring is thus advantageously saved.

In the contact-making position of the jumper, the movable contact, biased in the direction of the first stop, in the event of a short circuit or an overload, is preferably moved by the high-speed circuit breaker against the second stop, which is arranged on the jumper counter to the first stop, so that the current path is broken. In the event of a short circuit, the first lifting of the movable contacts is generally caused by electrodynamic lifting forces before the high-speed circuit breaker prevents the movable contact from falling back and moves it further in the direction of the second stop.

According to a further preferred embodiment, it is provided that a holding mechanism is provided on the jumper to hold the movable contact broken by the high-speed circuit breaker on the second stop. An advantage of this embodiment is that even with a reduction in the exciter current of the high-speed circuit breaker because of the extinguishing process, the current path remains broken. A falling back of the movable contact, a re-ignition of the arc or even a welding of the movable contact to the fixed contact can thus be advantageously avoided.

The holding mechanism preferably has a permanent-magnetic system to further hold the movable contact on the second stop, after a triggering of the high-speed circuit breaker, with a magnetic force counter to a spring force of the helical spring, the amount of magnetic force being greater than the amount of spring force. As the movable contact is brought by the high-speed circuit breaker into direct contact with the second stop, the magnetic force of the holding mechanism can advantageously act without an air gap on the movable contact. The at least one movable contact is preferably arranged for this purpose on a movable contact carrier made of a magnetically conductive material, in particular fastened thereto. It is particularly preferably provided that the movable contact carrier consists of a plated material having a first layer made of a copper material and a second layer made of a ferrous material.

According to a further preferred embodiment, it is provided that a resetting of the movable contact after a triggering of the high-speed circuit breaker takes place by means of a switching-off process of the drive for functional movement of the jumper. A separate mechanism for resetting the high-speed circuit breaker after a triggering is thereby saved.

For this purpose, a counter-stop preferably limits the movement range of the movable contact during a switching-off process of the drive, wherein the movable contact only reaches the counter-stop after a prior triggering of the high-speed circuit breaker, in other words after a breaking of the current path by the high-speed circuit breaker. In normal operation, without a triggering of the high-speed circuit breaker by a short circuit or an overload, the counter-stop does not influence the movement of the movable contact. Particularly preferably, a core of the high-speed circuit breaker, with the armature, forms the counter-stop. The movement of the movable contact is therefore limited to one movement range, in particular by the fixed contact, on the one hand, and, after a triggering of the high-speed circuit breaker, by the counter-stop, on the other hand. After a triggering of the high-speed circuit breaker, the contact-breaking position of the jumper is only reached after prior release of the movable contact from the holding mechanism because of the counter-stop. For this purpose, a greater resulting force is necessary than the holding force of the holding mechanism. This resulting force is composed of a force of the contact pressure spring and a force of the drive for the functional movement of the jumper. The force of the drive for the functional movement of the jumper is generally provided by a helical spring.

The invention will be described in more detail below with the aid of embodiments with reference to the accompanying drawings. The embodiments are merely exemplary and do not limit the general idea of the invention.

FIG. 1 is a simplified schematic view of the switching device according to the invention with a structure by way of example. The switching device for the on-off switching of a current passing through a current path 10 for this purpose has two fixed contacts 11, 12, which cooperate with two movable contacts 14, 15 on a movable contact carrier 16 for making and breaking the current path 10. An electromagnetic drive 1 is used for the functional movement of a jumper 17 between a contact-making position and a contact-breaking position, the movable contact carrier 16 being guided by the jumper 17, which will be dealt with in more detail in conjunction with the following drawings. A high-speed circuit breaker 2 for breaking the current path 10 in the event of a short circuit or an overload is also only shown schematically and the precise structure and functions will be described in more detail below with reference to the further drawings. Switching off short circuits requires a very rapid and permanent separation of the movable contacts 14, 15 from the fixed contacts 11, 12. In the event of short circuit currents, switching-off takes place by means of the high-speed circuit breaker 2, a first lifting of the movable contacts 14, 15 being caused by electrodynamic lifting forces. Arcs, which are in each case guided into extinguishing systems 21, are produced by the separation of the movable contacts 14, 15 from the fixed contacts 11, 12.

Figure 2:
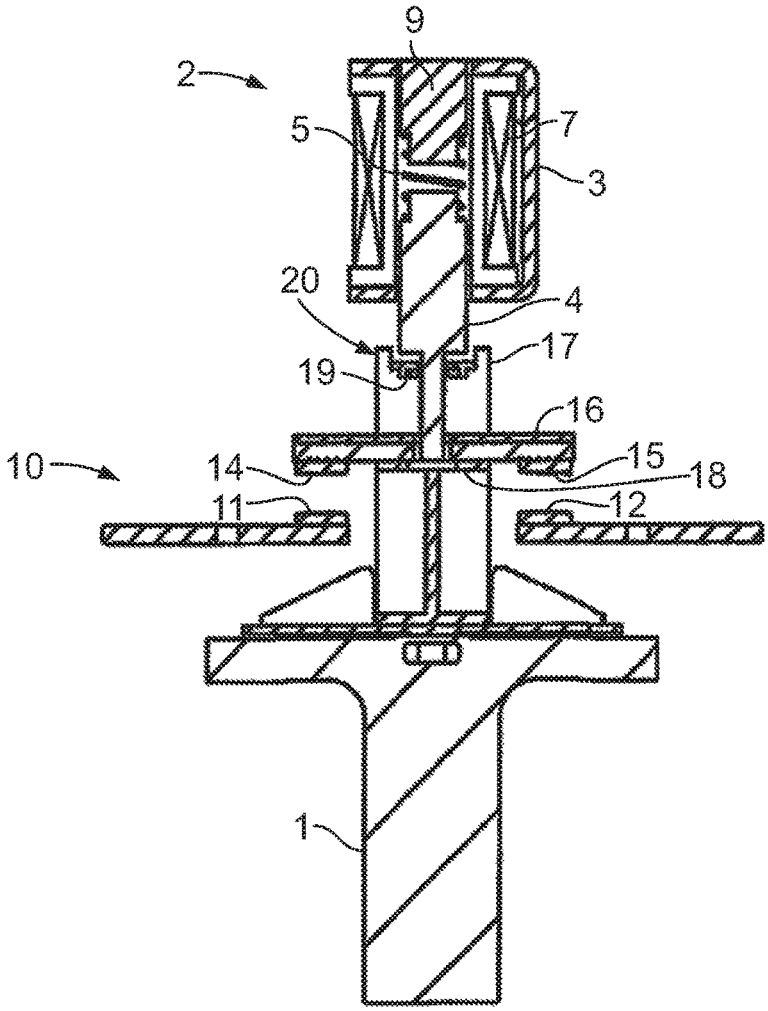
FIG. 2 a detailed view of a portion of an embodiment of the switching device according to FIG. 1 in a switched-off state.
Figure 3A:
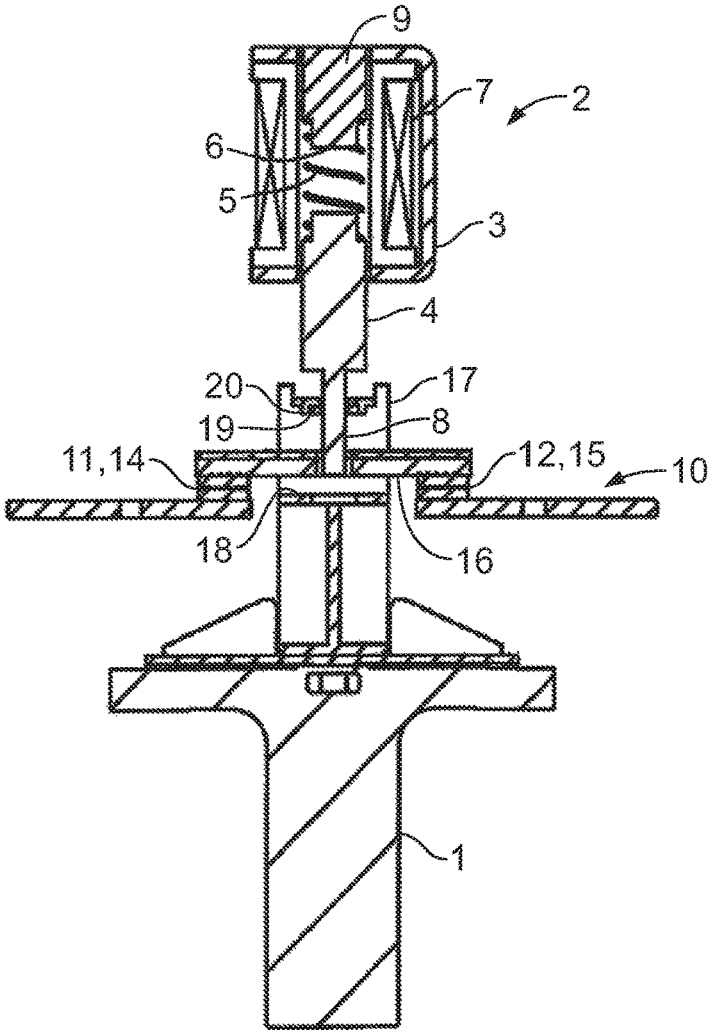
FIG. 3A-B detailed views of portions of the embodiment according to FIG. 2 in a switched-on state.
Figure 3B:
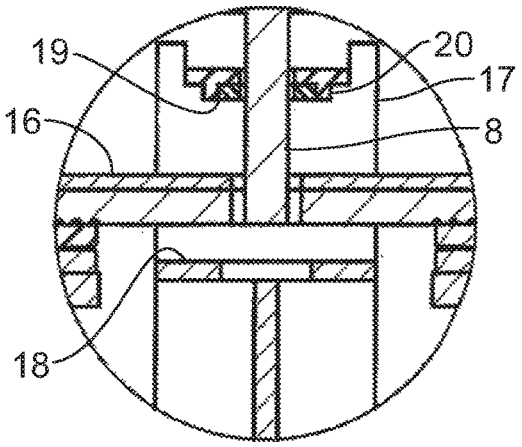

The structure of an embodiment of the switching device according to the invention will be described in more detail below with reference to FIGS. 2, 3A and 3B. FIG. 2 shows a detailed view of a portion of the switching device in a switched-off state, and FIGS. 3A and 3B show detailed views of portions of the switching device in a switched-on state. Of the electromagnetic drive 1 for the functional movement of a jumper 17, for the sake of simplicity only a drive armature 4 is shown, which is biased by a helical spring 5 in the direction of a position shown in FIG. 2 and, in the event of a switching-on process, is moved by a magnetic coil (not shown) in the direction of a position shown in FIG. 3A. The structure of a corresponding contactor drive 1 is adequately known to a person skilled in the art.

The drive 1 is provided for the functional movement of the jumper 17 between a contact-making position and a contact-breaking position, the jumper 17 being shown in the contact-breaking position in FIG. 2, in which the movable contacts 14, 15 are arranged removed from the fixed contacts 11, 12, the current path 10 thus being broken. The movable contacts 14, 15 are arranged on opposing ends of the movable contact carrier 16, which is in turn movably guided along the jumper 17 between a first stop 18 and a second stop 19. With the jumper 17 in the contact-breaking position according to FIG. 2, the movable contacts 14, 15, or the connecting movable contact carrier 16, rest on the first stop 18 of the jumper 17, so that a making of the contact path 10 is prevented. The movable contacts 14, 15 are biased by a contact pressure spring 5 against the first stop 18, which will be dealt with in more detail below in connection with the description of the high-speed circuit breaker 2. In the event of a switching-on process, the electromagnetic drive 1 is activated and moves the jumper 17 into its contact-making position, which is shown in FIG. 3A. The movement of the jumper 17 brings about a contacting of the movable contacts 14, 15 with the fixed contacts 11, 12 so that the current path 10 is made. The movable contact carrier 16 biased by the contact pressure spring 5 no longer rests on the first stop 18 of the jumper 17. A functional switching-off process takes place accordingly, in that the drive 1 is deactivated so that the helical spring of the drive 1 moves the jumper 17 back again into the contact-breaking position. The first stop 18 of the jumper 17 thus entrains the movable contacts 14, 15 arranged on the movable contact carrier 16 and thereby separates them from the fixed contacts 11, 12. The arcs being produced, as described in connection with FIG. 1, are guided into corresponding extinguishing systems 21.

The high-speed circuit breaker 2 is arranged opposing the drive 1 for functional switching, so that the current path 10 runs between the drive 1 and the high-speed circuit breaker 2. As a result, a particularly compact mode of construction of the switching device can be implemented. The high-speed circuit breaker 2 for breaking the current path 10 in the event of a short circuit or an overload has a core 9, a yoke 3, an armature 4 and a magnetic coil 7. The armature 4 is connected by a rigid coupling 8 to the movable contacts 14, 15 on the movable contact carrier 16. As a result, it is possible for the high-speed circuit breaker 2 to break the current path 10, while the jumper 17 is in the circuit-making position according to FIG. 3A. The contact pressure spring 5, which biases the movable contacts 14, 15 against the first stop 18 of the jumper 17, or against the fixed contacts 11, 12, is simultaneously the helical spring 5 for the armature 4 of the high-speed circuit breaker 2. The spring force is transmitted via the armature 4 and the rigid connection 8 to the movable contact carrier 16 with the movable contacts 14, 15.

In FIG. 3B, the jumper 17 is shown enlarged in the contact-making position according to FIG. 3A. It can be seen here that the movable contact carrier 16 is guided between the first stop 18 and the second stop 19 along the jumper 17. When the current path 10 is made, the movement of the movable contact carrier 16 in the direction of the contact-making position is limited by the movable contacts 14, 15 resting on the fixed contacts 11, 12, while the first stop 18 is moved further by the drive 1 so that a gap is produced between the first stop 18 on the jumper 17 and the movable contact carrier 16.

Figure 4A:
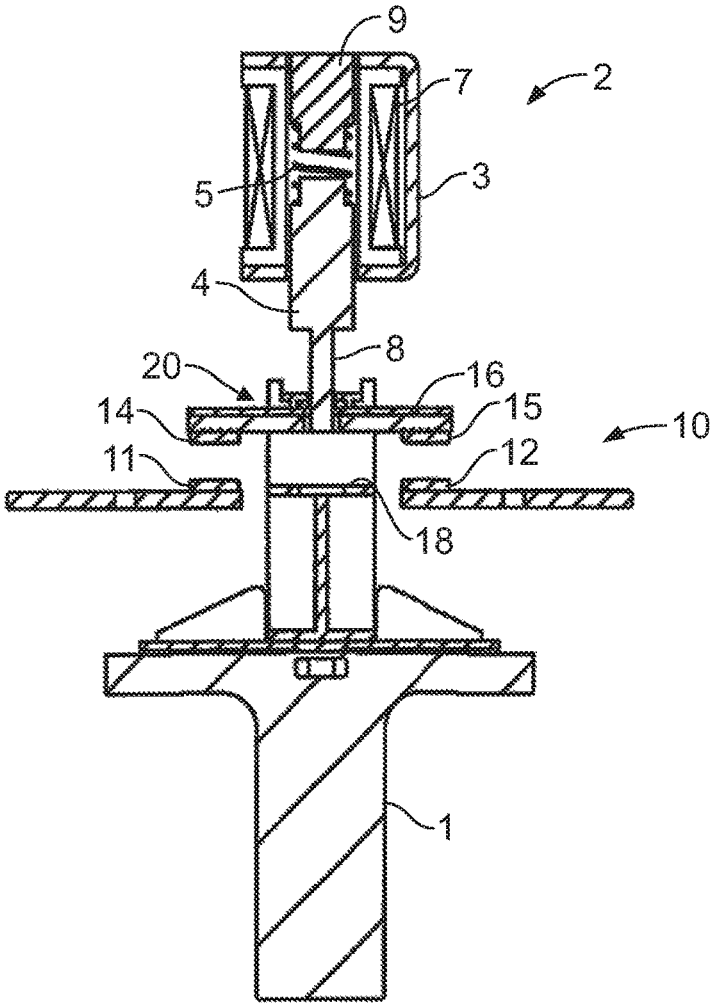
FIGS. 4A and 4B are detailed views of portions of the embodiment according to FIG. 2 in a state broken by the triggered high-speed circuit breaker.

A holding mechanism 20 is provided on the second stop 19 to hold the movable contacts 14, 15, which are broken by the high-speed circuit breaker 2, on the second stop 19. The triggering of the high-speed circuit breaker 2 will be further described below with reference to FIGS. 4A and 4B. A triggering current flowing through the magnetic coil 7 brings about the triggering of the high-speed circuit breaker 2 so that the armature 4 is attracted and the movable contacts 14, 15 on the movable contact carrier 16 are moved away from the fixed contacts 11, 12 by the rigid connection 8. The jumper 17 continues to be located in the contact-making position but the current path 10 is broken by the triggered high-speed circuit breaker 2. This means that the movable contacts 14, 15 are no longer in contact with the fixed contacts 11, 12 as they have been separated on the movable contact carrier 16 by the rigid connection 8 from the armature 4. The actual release of the movable contacts 14, 15 generally takes place here by the action of electrodynamic lifting forces before the high-speed circuit breaker 2 moves the movable contacts 14, 15 away from the fixed contacts 11, 12 to avoid a re-ignition of the switching arc or a welding of the contacts.

Figure 4B:
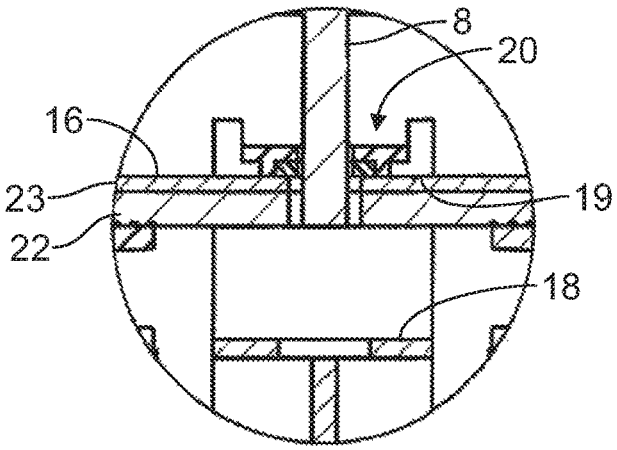

After triggering, the movable contacts 14, 15 on the movable contact carrier 16 rest on the second stop 19 of the jumper 17, as can be seen in particular in the enlarged view according to FIG. 4B. Owing to the breaking of the current path 10 and the removal of the arcs produced between the movable contacts 14, 15 and the fixed contacts 11, 12 into corresponding extinguishing systems 21 (see FIG. 1), the exciter current through the magnetic coil 7 drops, so that the helical spring 5 of the armature 4 would be able to move the movable contacts 14, 15 back again in the direction of the fixed contacts 11, 12. In order to safely prevent this, in the embodiments shown, the holding mechanism 20 is provided on the second stop 19 of the jumper 17, which prevents a release of the movable contacts 14, 15 with the movable contact carrier 16 from the stop 19. In the embodiment shown, a permanent magnet system is used as the holding mechanism 20, the magnetic force of which is sufficient to hold the movable contact carrier 16 resting on the stop 19 against the pressure of the helical spring 5. As a result, a safe switching-off of short circuit currents is ensured and a re-ignition of the switching arc or a welding of the contacts is avoided. The movable contact carrier 16 is in particular manufactured from a magnetically conductive material, preferably from a plated material having a first layer 22 made of a copper material and a second layer 23 made of a ferrous material.

Figure 5:
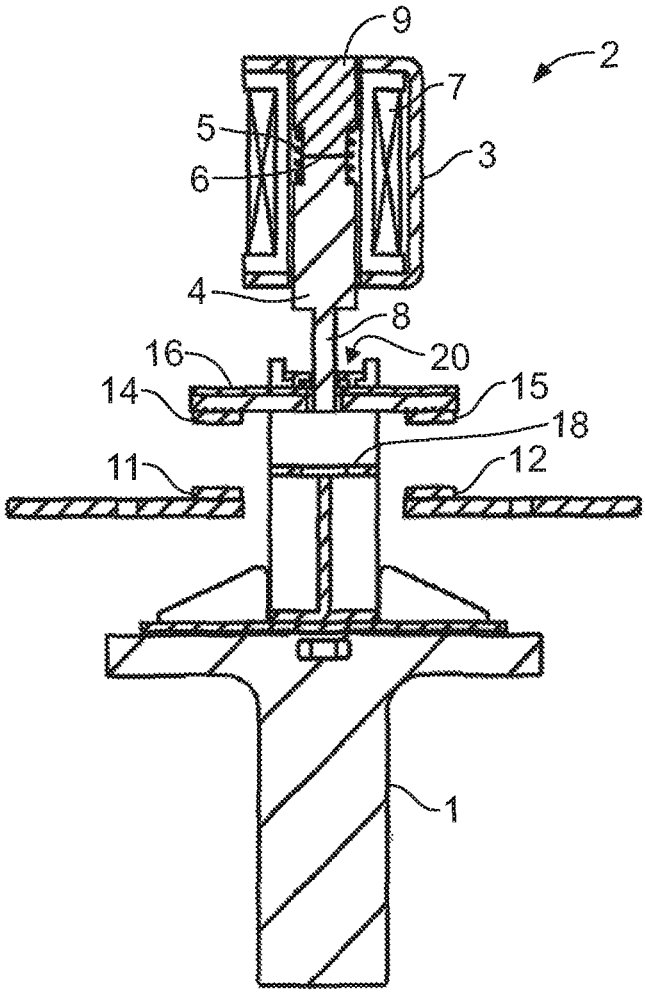
FIG. 5 a detailed view of a portion of the embodiment according to FIG. 2 in a reset state of the high-speed circuit breaker.

A further advantage of the switching device according to the invention is that the triggered high-speed circuit breaker 2 can be reset particularly easily to its starting state in that the drive 1 moves the jumper 17 from the contact-making position into the contact-breaking position. The reset process for the high-speed circuit breaker 2, which is shown in FIG. 5, thus advantageously takes place by a switching-off process, as has been previously described in connection with FIGS. 2, 3A and 3B. To reset the high-speed circuit breaker 2, the movable contacts 14, 15 on the movable contact carrier 16 have to be released from the second stop 19 with the holding mechanism 20. For this purpose, the movement of the movable contacts 14, 15 on the movable contact carrier 16 in the direction of the contact-breaking position of the jumper 17 is limited by a counter-stop 6, which is arranged in such a way that the contact-breaking position of the jumper 17 is not yet reached. The counter-stop 6 brings about a release of the movable contact carrier 16 from the second stop 19, so that the jumper 17 can again reach the contact-breaking position. The action of the counter-stop 6 is only provided after a triggering of the high-speed circuit breaker 2, as the movable contact carrier is only held in this case by the holding mechanism 20 on the second stop 19.

FIG. 5 shows precisely the position of the jumper 17, in which the movable contacts 14, 15 have reached their end position defined by the stop 6. The stop 6 in the embodiment shown is implemented in the form of a core 9 of the high-speed circuit breaker 2, against which the armature 4 impacts. The stop 6 may, however, also be implemented in a different manner, for example as a separate stop outside the jumper 17, against which the movable contact carrier 16 is moved. The jumper 17, in the position shown in FIG. 5, has not yet reached its contact-breaking position (cf. FIG. 2) so that the drive 1 moves the jumper 17 still further into the contact-breaking position, as a result of which the movable contacts 14, 15 on the movable contact carrier 16 are separated by the rigid connection 8 and the armature 4 from the second stop 19 with the holding mechanism 20, as the additional force from the drive 1 together with the force of the helical spring 5 exceeds the magnetic force of the holding mechanism 20. Thereafter, the switching device again reaches the position shown in FIG. 1 with the jumper 17 in the contact-breaking position and the movable contacts 14, 15, which are biased by the contact pressure spring 5 against the first stop 18 of the jumper 17. The switching device is therefore ready for a further switching-on process.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 drive for functional switching of the switching device
2 high-speed circuit breaker
3 yoke of the high-speed circuit breaker
4 armature
5 helical spring and contact pressure spring
6 counter-stop
7 magnetic coil
8 rigid coupling
9 core of the high-speed circuit breaker
10 current path
11 fixed contact
12 fixed contact
14 movable contact
15 movable contact
16 movable contact carrier
17 jumper
18 first stop
19 second stop
20 holding mechanism
21 extinguishing system for arcs
22 first layer
23 second layer

The invention claimed is:

1. A switching device for the on-off switching of a current passing through a current path, the switching device comprising:

a fixed contact;

a movable contact, the movable contact being moveable relative to the fixed contact so as to make or break the current path;

a drive configured for functional movement of a jumper between a contact-making position and a contact-breaking position, wherein, in the contact-making position with the fixed contact, the movable contact makes the current path; and a high-speed circuit breaker configured to break the current path in the event of a short circuit or an overload, wherein the movable contact is configured to be movably guided along the jumper between a first stop and a second stop and is rigidly coupled to an armature of the high-speed circuit breaker, the switching device further comprising a magnetic holding mechanism, provided on the jumper so as to hold the movable contact, broken by the high-speed circuit breaker, on the second stop.

2. The switching device of claim 1, wherein the holding mechanism includes a permanent-magnetic system to further hold the movable contact on the second stop, after a triggering of the high-speed circuit breaker, with a magnetic force counter to a spring force of the helical spring, and wherein an amount of the magnetic force is greater than the amount of spring force.

3. The switching device of claim 1, configured such that a resetting of the movable contact, after a triggering of the high-speed circuit breaker, takes place by a switching-off process of the drive.

4. The switching device of claim 1, configured such that a force resulting from a force of the contact pressure spring and a force of the drive is sufficient to release the movable contact from the holding mechanism.

5. The switching device of claim 1, wherein the movable contact is arranged on a movable contact carrier including a magnetically conductive material.

6. The switching device of claim 5, wherein the movable contact carrier includes a plated material including a first layer including copper and a second layer including iron.

7. The switching device of claim 1, wherein the armature is biased using a helical spring, so that the movable contact is biased by the helical spring in the direction of the first stop of the jumper.

8. The switching device of claim 7, wherein the helical spring of the armature acts as a contact pressure spring of the movable contact.

9. The switching device of claim 7, wherein, in the contact-making position of the jumper, the movable contact, biased in a direction of the first stop, in the event of a short circuit or an overload, is moved by the high-speed circuit breaker against the second stop, wherein the second stop is arranged on the jumper counter to the first stop, so that the current path is broken.

10. The switching device of claim 1, wherein, in the contact-breaking position of the jumper, the second stop lies outside a movement range of the movable contact.

11. The switching device of claim 10, further comprising:

a counter-stop configured to limit the movement range of the movable contact during a switching-off process of the drive, and wherein the movable contact only reaches a position of the counter-stop position after a prior breaking of the current path by the high-speed circuit breaker.

12. The switching device of claim 11, further comprising:

a core which, with the armature of the high-speed circuit breaker, forms the counter-stop.

13. A switching device for the on-off switching of a current passing through a current path, the switching device comprising:

a fixed contact;

a movable contact, the movable contact being moveable relative to the fixed contact so as to make or break the current path;

a drive configured for functional movement of a jumper between a contact-making position and a contact-breaking position, wherein, in the contact-making position with the fixed contact, the movable contact makes the current path;

a high-speed circuit breaker configured to break the current path in the event of a short circuit or an overload; and a counter-stop configured to limit the movement range of the movable contact during a switching-off process of the drive, wherein the movable contact is configured to be movably guided along the jumper between a first stop and a second stop and is rigidly coupled to an armature of the high-speed circuit breaker, wherein the movable contact is biased by a helical spring in the direction of the first stop of the jumper, and wherein the movable contact only reaches a position of the counter-stop after a prior breaking of the current path by the high-speed circuit breaker.

14. The switching device of claim 13, further comprising:

a core which, with the armature of the high-speed circuit breaker, forms the counter-stop.

* * * * *